United States Patent [19]

Jones

[11] Patent Number: 4,841,754

[45] Date of Patent: Jun. 27, 1989

[54] DEADBOLT DOOR HANDLE ASSEMBLY

[76] Inventor: Aroll A. Jones, 105 Cedarmont Cir., Nashville, Tenn. 37211

[21] Appl. No.: 208,968

[22] Filed: Jun. 20, 1988

[51] Int. Cl.[4] ..... E05B 15/02

[52] U.S. Cl. ..... 70/207; 16/124; 70/452; 292/347; 292/DIG. 63; D8/302; D8/307

[58] Field of Search ..... 16/124; D8/300–302, D8/307; 70/452, 449, DIG. 39, 207, 370, 417, 445; 292/DIG. 63, 336.3, 347, 356, 357

[56] References Cited

U.S. PATENT DOCUMENTS

| | | | |
|---|---|---|---|
| D. 79,216 | 8/1929 | Thomas | D8/302 |
| 420,854 | 2/1890 | Atkins | 70/452 |
| 1,487,264 | 3/1924 | Raymer | 16/124 X |
| 3,151,350 | 10/1964 | Manion | 70/452 |
| 3,699,788 | 10/1972 | Gerlach et al. | 70/417 X |
| 3,716,261 | 2/1973 | Gerlach | 292/357 X |
| 3,751,953 | 8/1973 | Newman | 70/452 X |
| 4,236,396 | 12/1980 | Surko, Jr. et al. | 292/357 X |

FOREIGN PATENT DOCUMENTS

| | | | |
|---|---|---|---|
| 160147 | 12/1954 | Australia | 292/336.3 |
| 478561 | 11/1951 | Canada | 70/452 |
| 737263 | 7/1943 | Fed. Rep. of Germany | 292/356 |
| 1029007 | 5/1966 | United Kingdom | 70/452 |

*Primary Examiner*—Lloyd A. Gall

*Attorney, Agent, or Firm*—Harrington A. Lackey

[57] ABSTRACT

A door handle assembly adapted to be mounted upon a deadbolt lock assembly so that said door handle assembly forms a part of the deadbolt lock assembly. Preferably, the door handle assembly includes an outside door handle member mounted upon the outside face of the door and surrounding the lock cylinder and an inside door handle assembly mounted upon the inside face of the door and surrounding the turn-key of the deadbolt assembly.

9 Claims, 1 Drawing Sheet

DEADBOLT DOOR HANDLE ASSEMBLY

BACKGROUND OF THE INVENTION

This invention relates to door handles, and more particularly to a combination door handle and deadbolt assembly.

A typical deadbolt lock assembly is installed in a door and includes a lock cylinder with a key for operating the deadbolt on the outside and a thumb key for operating the deadbolt on the inside of the door. A separate door handle is mounted on the outside of the door and another door handle mounted on the inside of the door for opening and closing the door when the door is unlocked. These door handles are completely independent of the deadbolt lock assembly.

The following U.S. patents disclose various types of door handles adapted to be mounted upon the lock cylinder of a door:

Des. 161,427, Crain, Jan. 2, 1951;
Des. 164,101, Crain, July 31, 1951;
1,720,637, Wread, July 9, 1929;
3,119,474, Grossman, Jan. 28, 1964.

All of the above patents disclose various types of door handles which are integrally connected with a plate or escutcheon having a circular opening for receiving a lock cylinder. However, all of the patents disclose only a single door handle mounted on the outside of the door around the exterior lock cylinder. Moreover, none of the patents disclose a door handle having an annular collar for fitting around the lock cylinder or the inside thumb key, much less a collar having an annular recess for receiving and preventing lateral shifting of the corresponding lock cylinder housing or the thumb key housing.

SUMMARY OF THE INVENTION

The deadbolt door handle assembly made in accordance with this invention includes a door handle member having an annular collar supporting a depending handle in which the collar is adapted to fit flush against the corresponding face of the door and is provided with an annular recess for receiving the rim of the assembly housing, either the lock cylinder housing or the thumb key housing.

Preferably, the door handle assembly includes a pair of handle members, an outside handle member and an inside handle member, each having an annular collar to fit flush against the respective inside and outside faces of a door and coaxial with the lock cylinder. Each of the collars is provided with an annular recess for receiving the corresponding circular rims of the outside lock cylinder housing and the inside thumb key housing to hold in place the respective housings, against lateral movement. Depending from each of the annular collars is a substantially coplanar strap from the bottom of which projects upward a corresponding outside and inside handle arm, which terminates below the corresponding housing.

DESCRIPTION OF THE PREFERRED EMBODIMENT

Figures 1, 2, 3:
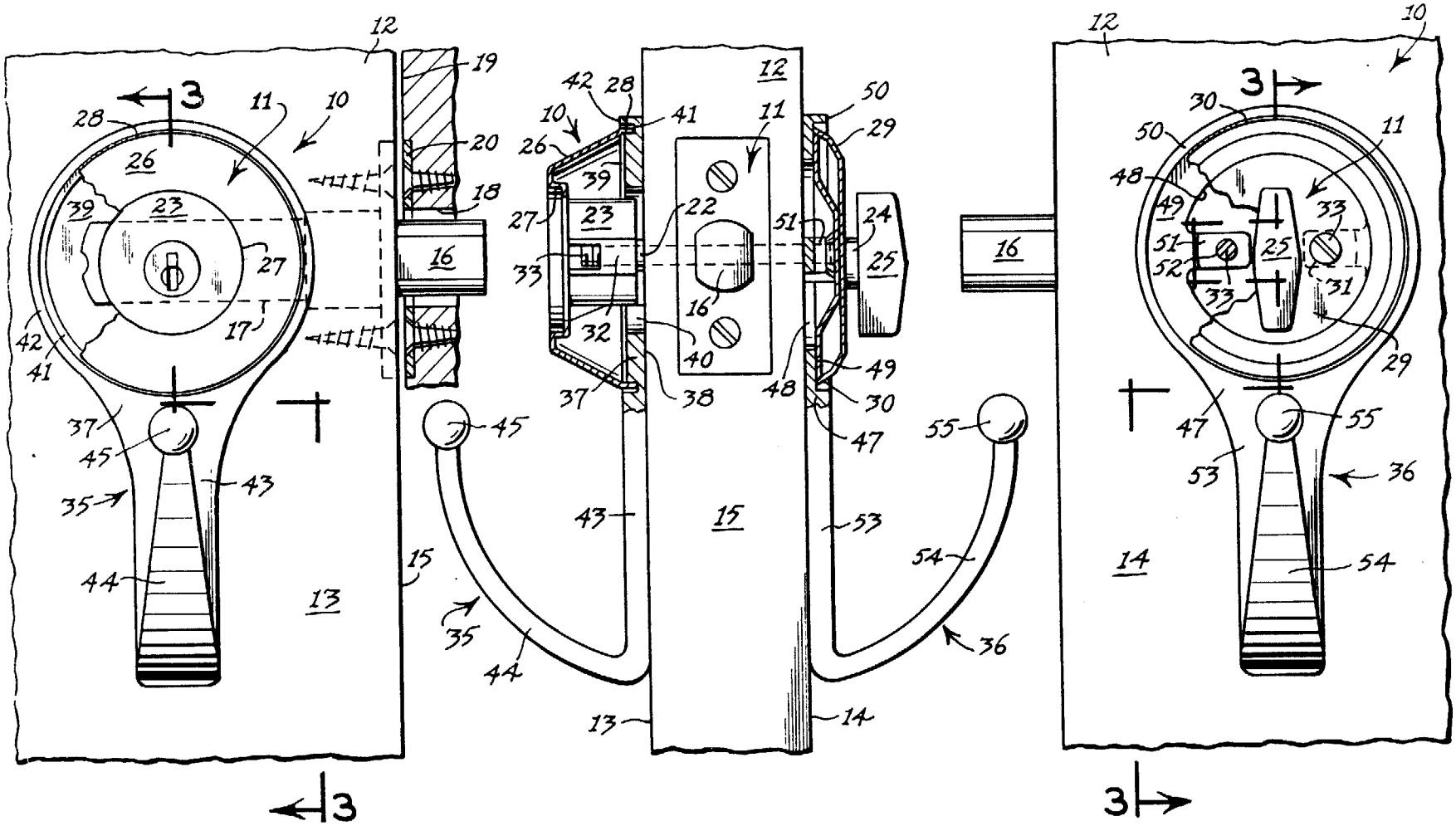
FIG. 1 is a front, or an outside, fragmentary, elevational view of the door handle assembly, made in accordance with this invention, mounted in operative position upon the outside face of a door in cooperation with the lock cylinder, with portions broken away.
FIG. 2 is a rear, or inside, elevational view of the handle assembly, made in accordance with this invention, mounted upon the inside face of the door in cooperation with the thumb key housing, with portions broken away.
FIG. 3 is a fragmentary end elevational view of the door with fragmentary sections of the outside and the inside door handle members taken along the lines 3—3 of FIGS. 1 and 2.

Referring now to the drawings in more detail, the door handle assembly 10 made in accordance with this invention is disclosed cooperating with a deadbolt assembly 11 mounted in a conventional manner within the edge portion of a door 12 having a front or outside face 13, a rear or inside face 14, and a free edge surface 15. The deadbolt lock assembly 11 includes the deadbolt 16 reciprocably received within a deadbolt housing 17 for reciprocal movement. The deadbolt 16 cooperates with a keeper recess 18 within the door jamb 19 and framed by the striker plate 20, (FIG. 1). The deadbolt 16 is manipulated through a mechanism, not shown, within the deadbolt housing 17 by means of an elongated stem 22 rotatably carried within the lock cylinder 23 projecting from the outside face 13 of the door 12. The stem 22 extends through the deadbolt housing 17 and terminates within a socket 24 within the thumb key 25.

Normally, the lock cylinder 23 is mounted on the outside face 13 of the door 12 and supported in place by a lock cylinder housing 26, such as the truncated conical lock cylinder housing 26, illustrated in FIGS. 1 and 3. The face of the lock cylinder 23 is normally seated within a recess 27 in the small outer end portion of the housing 26. The larger or base end portion of the housing 26 terminates in a circular rim 28.

Normally, the thumb key socket 24 is rotatably journaled within the center of an annular thumb key housing 29 having a circular base rim 30 normally fitting against the interior surface 14 of the door 12. Formed on opposite sides of the thumb key 25 and extending through the thumb key housing 29 are bolt holes 31. These bolt holes 31 are axially aligned with corresponding bolt holes within the deadbolt housing 17, not shown, and internally threaded sockets 32 in the lock cylinder 23, for receiving corresponding bolts 33, in order to hold the entire deadbolt lock assembly 11 in position upon the door 12.

The handle assembly 10 includes an outside handle member 35 and an inside handle member 36. The outside handle member 35 includes an annular collar member 37 having a rear or inside flat surface 38 for fitting flush against the front or outside face 13 of the door 12, as illustrated in FIG. 3. The front surface of the outside collar member 37 includes an annular recess 39 surrounding a central opening or hole 40 through which extends the lock cylinder 23 and the stem 22. In a preferred form of the invention, the perimeter of the recess surface 39 terminates in a deeper circular groove 41 surrounded by an external circular ledge 42 of a diameter commensurate with the diameter of the base rim 28 of the truncated conical lock cylinder housing 26, which is received within the groove 41. The outer circular ledge 42, as well as the groove 41, limit the lateral or radial movement of the housing 26 relative to the annular collar member 37.

Extending co-extensively, such as downward, from the outside annular collar member 37 is a strap member 43 the lower end of which is attached to, or more specifically merges with, the bottom portion of a handle arm 44 projecting forward or outwardly from the door 12 and upwardly, terminating in a spherical end member 45.

The inside handle member 36 also includes an annular inside collar member 47 having a central circular hole or opening 48 surrounded by an annular recess 49 terminating in an inward or rearward projecting annular ledge 50. The annular ledge 50 has a diameter substantially the same as or slightly greater than the diameter of the annular rim 30 of the housing 29 to receive the rim 30 and prevent it from shifting laterally or radially relative to the annular collar member 47.

Projecting radially inward from diametrically opposite sides of the hole 48 are a pair of bolt guide members 51 including bolt holes 52. Each bolt hole 52 is also in axial alignment with the corresponding remaining bolt holes, such as 31, previously described, for axially receiving and being secured to the bolts 33.

It is also within the scope of this invention to provide annular grooves, similar to the annular grooves 41 in the collar member 37, within the recess 49 adjacent the inside of the annular ledge 50 of the collar member 47.

Depending from the inside annular collar member 47 is a strap member 53 similar to the strap member 43, the lower end portion of which joins the bottom end portion of an inward and upward projecting arcuate inside handle arm 54 terminating in a spherical end member 55.

The handle arms 44 and 54 must be spaced far enough from the strap members 43 and 53 respectively to provide ample room for the operator of the door handle to fit his hand between the arm and the corresponding strap member. Both terminal end portions 45 and 55 of the handle arms 44 and 54 preferably terminate below the longitudinal axis of the lock cylinder 23 to permit access to the lock cylinder 23 by an operator with a key, and to permit access to the thumb key 25 for rotation, without interference from the handle arms 44 and 54, respectively.

Although both handle arms 44 and 54 are shown as bowshaped or arcuate convex outward and downward, nevertheless, the particular configuration of the handle bars including the strap members 43 and 53 and the arms 44 and 54 may vary.

It is therefore apparent from the above description that a handle assembly 10 has been provided in which the deadbolt lock assembly 11 for a door 12 is provided with handles on both the outside and the inside of the door which are mounted in combination with the lock assembly, and therefore eliminate the necessity of furnishing independent and separately installed door handles. Moreover, the handle members 35 and 36 are readily accessible to a person operating the deadbolt lock from either the outside or the inside after the door has been unlocked.

What is claimed is:

1. In a door having a vertical outside face, a vertical inside face, and a vertical edge surface, and a deadbolt assembly mounted on the door including a deadbolt housing within the door carrying a reciprocable deadbolt for movement through the edge surface, a lock cylinder operatively connected to the deadbolt, an inside thumb key operatively connected to the deadbolt, aligned bolt holes extending through the deadbolt housing, and the lock cylinder, a door handle assembly comprising:

(a) an annular lock cylinder housing having outer and inner end portions, an opening through said outer end portion for receiving a lock cylinder having an enlarged face, a recess in said outer end portion of said lock cylinder housing surrounding said opening for receiving said face and limiting the axial movement of said lock cylinder toward said inner end portion, said inner end portion comprising a circular rim opposing the outside face of said door, (b) a thumb key housing surrounding said thumb key and having a circular rim opposing the inside face of said door, (c) bolt holes in said thumb key housing aligned with the corresponding bolt holes in said deadbolt housing and said lock cylinder, (d) a collar member having an opening therethrough coaxial with said lock cylinder housing, said collar member having a flat inner face fitting flush against a face of said door, (e) said collar member having an outer annular recess receiving the circular rim of said lock cylinder housing or said thumb key housing, (f) said collar member further comprising an annular ledge of slightly greater diameter than the diameter of the circular rim of the corresponding housing to restrain lateral movement of said corresponding housing received within said recess, (g) said collar member further comprising a strap member having a flat rear surface coplanar with said flat inner face of said collar, and a handle arm projecting forward from said strap member, and (h) bolts extending through said aligned bolt holes in operative position for securing said housings against opposite faces of said door.

2. The door handle assembly according to claim 1 in which said collar member comprises an outer collar member, said flat inner face fitting flush against the outside face of said door and said annular recess receiving said circular rim of said lock cylinder housing.

3. The door handle assembly according to claim 2 further comprising an inside collar member having an inside collar opening, said inside collar member having a flat inner face fitting flush against the inside face of the door, said inside collar member having an outer annular recess receiving said circular rim of said thumb key housing.

4. The door handle assembly according to claim 1 in which said collar member comprises an inside collar member, said flat inner face fitting flush against the inside face of the door and said outer annular recess receiving said circular rim of said thumb key housing.

5. The door handle assembly according to claim 4 further comprising a bolt guide for each bolt projecting from said inside collar member radially inwardly into said opening, each said bolt guide having a bolt hole in axial alignment with a corresponding bolt hole in said thumb key housing, said deadbolt housing, and said lock cylinder for receiving a corresponding bolt in a secured operative position.

6. The door handle assembly according to claim 1 in which said collar member is further provided with an annular groove formed in said annular recess adjacent said annular ledge whereby said annular rim of said corresponding housing seats within said annular groove.

7. The door handle assembly according to claim 1 in which said strap member is substantially coplanar with said collar member.

8. The door handle assembly according to claim 1 in which said handle arm is fixedly secured to the bottom portion of said strap member.

9. The door handle assembly according to claim 8 in which said handle arm projects away from said strap member and upward.

* * * * *